US009870737B2

(12) United States Patent
Lee et al.

(10) Patent No.: US 9,870,737 B2
(45) Date of Patent: Jan. 16, 2018

(54) SENSING CIRCUIT AND ORGANIC LIGHT EMITTING DIODE DISPLAY DEVICE HAVING THE SAME

(71) Applicant: LG DISPLAY CO., LTD., Seoul (KR)

(72) Inventors: ChulWon Lee, Seoul (KR); SeungTae Kim, Goyang-si (KR)

(73) Assignee: LG DISPLAY CO., LTD., Seoul (KR)

( * ) Notice: Subject to any disclaimer, the term of this patent is extended or adjusted under 35 U.S.C. 154(b) by 26 days.

(21) Appl. No.: 14/971,203

(22) Filed: Dec. 16, 2015

(65) Prior Publication Data

US 2016/0189622 A1 Jun. 30, 2016

(30) Foreign Application Priority Data

Dec. 26, 2014 (KR) ..... 10-2014-0191076

(51) Int. Cl.

| | |
|---|---|
| ***G09G 5/00*** | (2006.01) |
| ***G09G 3/3258*** | (2016.01) |
| ***G09G 3/3233*** | (2016.01) |
| ***G09G 3/3291*** | (2016.01) |

(52) U.S. Cl.

CPC ..... *G09G 3/3258* (2013.01); *G09G 3/3233* (2013.01); *G09G 3/3291* (2013.01); *G09G 2300/0842* (2013.01); *G09G 2300/0866* (2013.01); *G09G 2310/08* (2013.01); *G09G 2320/0295* (2013.01); *G09G 2320/043* (2013.01)

(58) Field of Classification Search

CPC ... G09G 3/32; G09G 5/00; G09G 3/10; G06F 3/038

See application file for complete search history.

(56) References Cited

U.S. PATENT DOCUMENTS

| | | | | |
|---|---|---|---|---|
| 5,113,077 | A | 5/1992 | Shimizu et al. | |
| 2011/0122119 | A1* | 5/2011 | Bae | G09G 3/3233 345/211 |
| 2012/0206506 | A1* | 8/2012 | Kim | G09G 3/20 345/690 |
| 2012/0262411 | A1* | 10/2012 | Ahn | G06F 3/0416 345/174 |
| 2013/0050292 | A1* | 2/2013 | Mizukoshi | G09G 3/3291 345/690 |
| 2013/0162617 | A1 | 6/2013 | Yoon et al. | |
| 2014/0022289 | A1 | 1/2014 | Lee et al. | |
| 2014/0139510 | A1 | 5/2014 | Han et al. | |
| 2014/0176525 | A1 | 6/2014 | Woo et al. | |
| 2014/0184568 | A1* | 7/2014 | Kim | G06F 3/0416 345/175 |

(Continued)

FOREIGN PATENT DOCUMENTS

| | | |
|---|---|---|
| CN | 102074189 A | 5/2011 |
| CN | 103177685 A | 6/2013 |

(Continued)

*Primary Examiner* — Pegeman Karimi

(74) *Attorney, Agent, or Firm* — Birch, Stewart, Kolasch & Birch, LLP

(57) ABSTRACT

A sensing circuit capable of simplifying a configuration of a data driver by reducing a size of a sensing circuit provided at each data driver, and an organic light emitting diode (OLED) display device having the same are provided. The sensing circuit includes N sampling and holding circuits, a scaler and an analog-digital converter.

15 Claims, 5 Drawing Sheets

(56) References Cited

U.S. PATENT DOCUMENTS

| | | | | |
|---|---|---|---|---|
| 2014/0368415 | A1 | 12/2014 | Kim et al. | |
| 2015/0091888 | A1* | 4/2015 | Min | G09G 3/3291 345/212 |

FOREIGN PATENT DOCUMENTS

| | | | |
|---|---|---|---|
| CN | 104094341 | A | 10/2014 |
| JP | 3-122588 | A | 5/1991 |
| JP | 2006-269374 | A | 9/2006 |
| JP | 2014-123125 | A | 7/2014 |
| KR | 10-2013-0078182 | A | 7/2013 |
| KR | 10-2014-0022153 | A | 2/2014 |

* cited by examiner

SENSING CIRCUIT AND ORGANIC LIGHT EMITTING DIODE DISPLAY DEVICE HAVING THE SAME

CROSS-REFERENCE TO RELATED APPLICATION

Pursuant to 35 U.S.C. §119(a), this application claims the benefit of earlier filing date and right of priority to Korean Patent Application No. 10-2014-0191076, filed on Dec. 26, 2014, the contents of which is incorporated by reference herein in its entirety.

BACKGROUND OF THE INVENTION

Field of the Invention

The invention relates to a sensing circuit, and more particularly, a sensing circuit, capable of simplifying a configuration of a data driver by reducing a size of a sensing circuit provided at each data driver, and to an organic light emitting diode (OLED) display device having the same.

Discussion of the Related Art

An organic light emitting diode (OLED) display device has advantages of fast response speed, high luminous efficiency, high brightness and a great viewing angle by virtue of using self-illuminating diodes which emit light by themselves. The OLED display device is configured in such a manner that pixels each including an OLED as such a self-illuminating diode are arranged on a display panel, and the brightness of a pixel selected by a gate signal is controlled according to a gray scale level of a data signal so as to display an image.

FIG. 1 is an equivalent circuit view of one pixel of an OLED display device according to the related art.

As illustrated in FIG. 1, each pixel P of an OLED display device includes an OLED, a gate line GL, a sensing line SL and a data line DL intersecting with one another, a first switching thin film transistor (TFT) ST1, a second switching TFT ST2, a driving TFT DT and a storage capacitor Cst.

The first switching TFT ST1 is turned on in response to a gate signal input from the gate line GL, and allows for a flow of an electric current (conducts a current) between a source electrode and a drain electrode. The first switching TFT ST1 applies a data signal input through the data line DL to the driving TFT DT and the storage capacitor Cst during its turn-on period. The second switching TFT ST2 is turned on in response to a sensing signal input from the sensing line SL, and applies a reference voltage Vref supplied through a reference line RL to an anode electrode of the OLED. The driving TFT DT controls a current which flows from a power source voltage EVDD to the OLED during its turn-on period. The storage capacitor Cst uniformly maintains a gate potential of the driving TFT DT for one frame. The OLED is connected between the driving TFT DT and a ground voltage EVSS.

The aforementioned pixel P of the OLED display device displays an image in a manner that the OLED continuously emits light for a frame section and thus the driving TFT DT is kept maintained in the turn-on state. This causes deterioration of the driving TFT DT. To solve this problem, in the related art OLED display device, a method of sensing a change of a threshold voltage Vth and a change of a characteristic of the OLED and compensating for the changes has been proposed.

FIG. 2 is a view illustrating a part of the related art OLED display device.

As illustrated in FIG. 2, the related art OLED display device includes a display panel 10 and a sensing unit.

On the display panel 10, the pixels P described in FIG. 1 are arranged in a matrix configuration.

The sensing unit includes a sampling and holding portion 20, a scaling portion 30, an amplifier 40, and an analog-digital converter 50.

The sampling and holding portion 20 is connected to a plurality of reference lines RL, namely, the second switching TFT ST2 of each pixel P. The sampling and holding portion 20 temporarily stores sensing voltages supplied through the plurality of reference lines RL, through which the reference voltage Vref is supplied, and senses a characteristic change, such as a change of a threshold voltage of the display panel 10. One sampling and holding portion 20 is connected to a preset number of reference lines RL to temporarily store the sensing voltages. A plurality of first switches SW1 are disposed between the sampling and holding portion 20 and the reference lines RL to control a supply of the sensing voltages applied from the reference lines RL to the sampling and holding portion 20. The sampling and holding portion 20 includes a second switch SW2, a third switch SW3 and a first capacitor C1, and stores a voltage in the first capacitor C1 according to switching operations of the second switch SW2 and the third switch SW3.

The scaling portion 30 is arranged to correspond to the sampling and holding portion 20 in an one-to-one manner. The scaling portion 30 adjusts the level of the sensing voltages supplied from the sampling and holding portion 20 in a manner of scaling the sensing voltages. The scaling portion 30 includes a fourth switch SW4, a fifth switch SW5 and a second capacitor C2.

The level-adjusted (or scaled) sensing voltages by the scaling portion 30 are applied to an ADC 50 via the amplifier 40. The ADC 50 outputs sensing data SD through an analog-digital conversion of the level-adjusted sensing voltages.

The sensing unit is provided at each of a plurality of data drivers each having a form of a driving integrated circuit (DIC) connected to the display panel 10.

Accordingly, one data driver of the related art OLED display device includes the sensing unit provided with the plurality of sampling and holding portions 20 and the plurality of scaling portions 30, which causes an increase in the size of the data driver.

In addition, in the related art OLED display device, a plurality of sixth switches SW6 are provided between the plurality of scaling portions 30 and the amplifier 40. The plurality of sixth switches SW6 sequentially perform a switching operation such that the scaled voltages are transferred to the ADC 50. In this instance, parasitic capacitance is generated, in response to the switching operation of the plurality of sixth switches SW6, and thereby causes errors in the scaling voltages. More errors are generated when the number of the scaling portion 30 increases, namely, the number of the sixth switch SW6 increases. This results in lowering operation reliability of the sensing unit.

SUMMARY OF THE INVENTION

Therefore, an aspect of the detailed description according to the embodiments of the present invention is to provide a sensing circuit, capable of enhancing operation reliability with a reduced size, and an organic light emitting diode (OLED) display device having the same.

To achieve these and other advantages and in accordance with the purpose of this specification, as embodied and broadly described herein, there is provided a sensing circuit including N sampling and holding circuits, a scaler and an analog-digital converter, where N may be a positive integer, for example.

The N sampling and holding circuits may output a plurality of sampling voltages from a plurality of sensing voltages sequentially input through a plurality of reference lines.

The scaler may be connected commonly to the N sampling and holding circuits, and output a plurality of scaling voltages from the plurality of sampling voltages output from the N sampling and holding circuits.

The analog-digital converter may output a plurality of sensing data by performing an analog-digital conversion for the plurality of scaling voltages output from the scaler.

To achieve these and other advantages and in accordance with the purpose of this specification, as embodied and broadly described herein, there is provided an organic light emitting diode (OLED) display device including a display panel, a data driver and a timing controller.

The display panel may include a plurality of pixels, and a plurality of reference lines connected to each of the plurality of pixels, each of the pixels having an organic light emitting diode (OLED).

The data driver may include a sensing circuit to output sensing data from the sensing voltages input through the plurality of reference lines. The timing controller may generate compensation image data from image data according to sensing data output from the sensing circuit, and output the compensation image data to the display panel through the data driver.

A sensing circuit according to an embodiment of the present invention may be provided with a single scaler corresponding to a plurality of sampling and holding circuits, resulting in a reduction of sizes of the sensing circuit and each data driver having the sensing circuit.

A scaler can be configured as a current integrator using an OPAMP, so as to minimize an affection of parasitic capacitance, which is generated due to a switching operation of a second switch module, by virtue of the OPAMP, as compared with the related art sensing unit. Consequently, a generation of an error in a scaling voltage output from the scaler due to the parasitic capacitance can be prevented, which may result in outputting more accurate sensing data.

Accordingly, the OLED display device according to an embodiment of the present invention can accurately compensate for a data signal applied to a driving transistor of each pixel by receiving sensing data according to a variation of a threshold voltage through the sensing circuit, which may result in improvement of display quality.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE EMBODIMENTS

Description will now be given in detail of a sensing circuit and an OLED display device having the same according to one or more embodiments of the present invention, with reference to the accompanying drawings. In the embodiments, n, m, or N may be positive integers.

Figure 1:
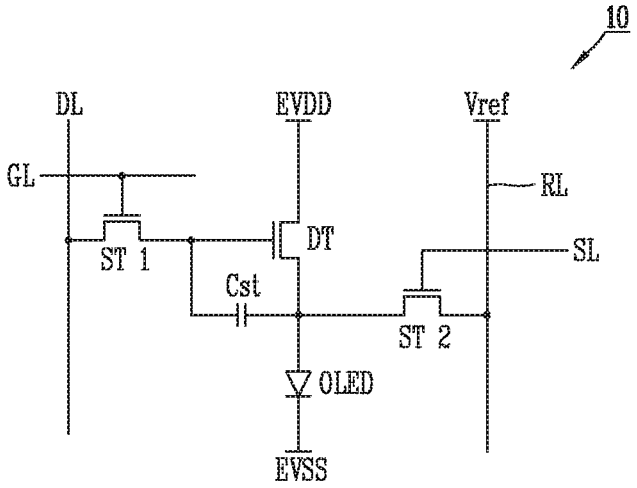
FIG. 1 RELATED ART
FIG. 1 is an equivalent circuit view of one pixel of an OLED display device according to the related art.
Figure 2:
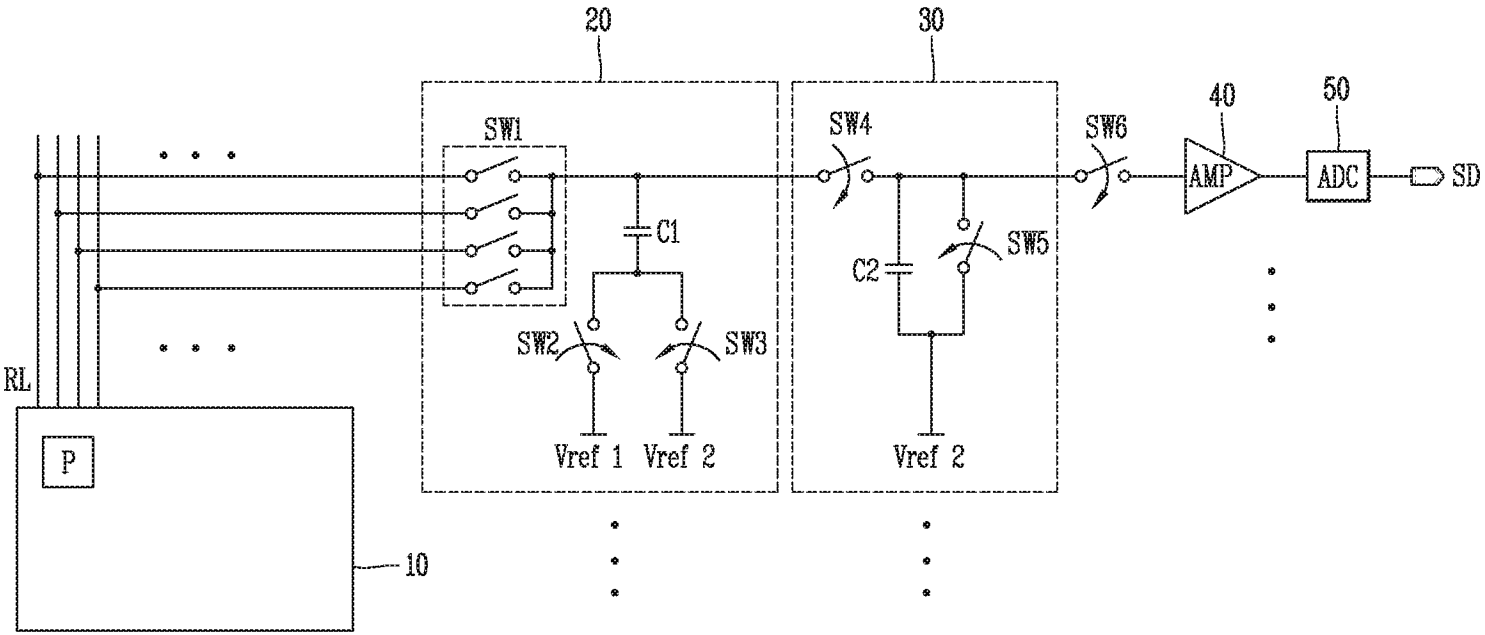
FIG. 2 RELATED ART
FIG. 2 is a view illustrating a part of the related art OLED display device.
Figure 3:
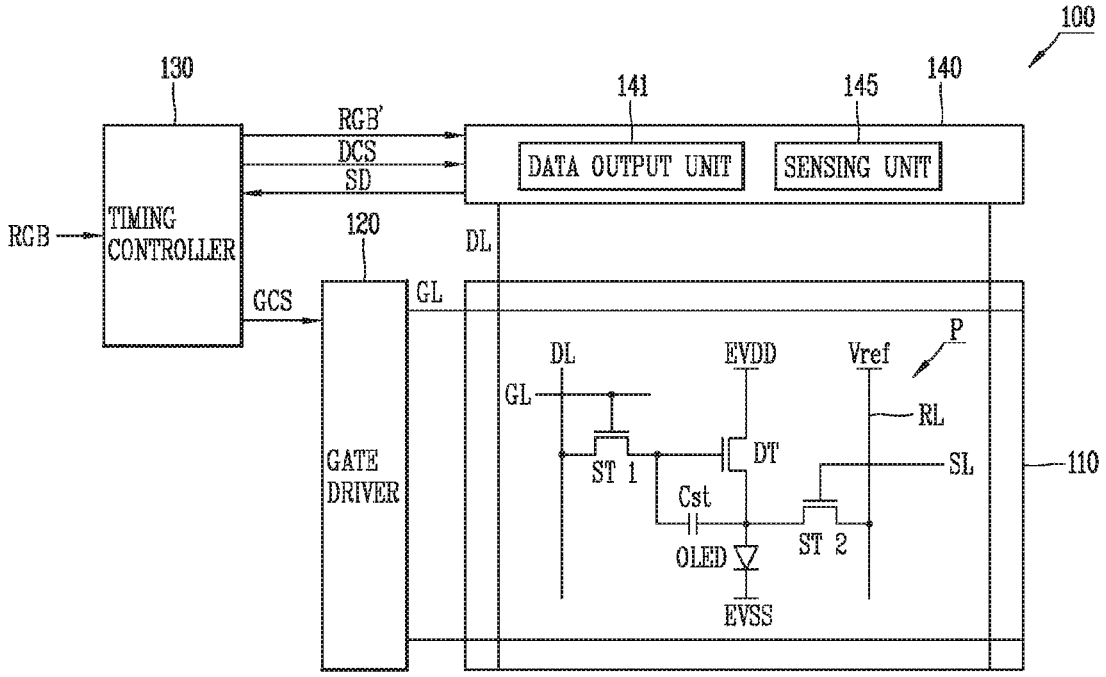
FIG. 3 is a configuration view of an OLED display device in accordance with one exemplary embodiment of the present invention.

FIG. 3 is a configuration view of an OLED display device in accordance with one exemplary embodiment of the present invention. All the components of the OLED display device according to all embodiments of the present invention are operatively coupled and configured.

As illustrated in FIG. 3, an OLED display device 100 according to this exemplary embodiment may include a display panel 110, a gate driver 120, a data driver 140 and a timing controller 130.

The display panel 110 may include a plurality of gate lines GL, sensing lines SL and data lines DL intersecting with one another, and pixels P arranged on the intersections, respectively, in a matrix configuration.

Each of the pixels P may include an OLED, a first switching TFT ST1, a second switching TFT ST2, a driving TFT DT and a storage capacitor Cst.

The OLED may be connected between the driving TFT DT and a ground voltage EVSS, and emit light by a current flowing between a driving voltage EVDD and the ground voltage EVSS. The first switching TFT ST1 may be turned on in response to a gate signal input through the gate line GL, and transfer a data signal input through the data line DL to the driving TFT DT and the storage capacitor Cst. The second TFT ST2 may be turned on in response to a sensing signal input through the sensing line SL, and apply a reference voltage Vref supplied through the reference line RL to an anode electrode of the OLED. The driving TFT DT may be connected between the driving voltage EVDD and the OLED, and may adjust an amount of current flowing to the OLED according to a voltage applied between the driving voltage EVDD and the gate electrode. The storage capacitor Cst may be connected between the first switching TFT ST1 and the driving TFT DT.

The gate driver 120 may generate a gate signal according to a gate control signal GCS applied from the timing controller 130. The gate signal may be applied to the plurality of gate lines GL of the display panel 110. The gate driver 120 may be formed on the display panel 110 in a gate in panel (GIP) manner.

The data driver 140 may convert an image data, for example, a compensation image data RGB', into an analog type data signal according to a data control signal DCS applied from the timing controller 130. The data driver 140 may output the data signal through the plurality of data lines DL of the display panel 110.

The data driver 140 may also generate sensing data SD by sensing characteristic changes of a threshold voltage Vth, mobility and the like of the driving TFT DT of the pixel P through the plurality of reference lines RL, and output the generated sensing data SD to the timing controller 130.

To this end, the data driver 140 may include a data output unit 141 and a sensing unit 145. The data output unit 141 may output the compensation image data RGB' provided from the timing controller 130 to the plurality of data lines DL of the display panel 110.

The sensing unit 145 may sense the characteristic changes of the threshold voltage Vth, the mobility and the like of the driving TFT DT of the pixel P through the reference lines RL, and generate sensing data SD based on the sensed characteristic changes for output.

The data driver 140 may be configured in the form of a plurality of driving integrated circuits, each of which may be connected to a predetermined number of gate lines of the plurality of data lines DL.

The timing controller 130 may generate a gate control signal GCS and a data control signal DCS from a control signal input from an external system. Examples of the control signal may include a vertical sync signal Vsync, a horizontal sync signal Hsync, a dot clock signal DCLK, a data enable signal DE and the like. The gate control signal GCS may be output to the gate driver 120 and the data control signal DCS may be output to the data driver 140.

The timing controller 130 may also generate image data by converting an image signal RGB input from an external system to be suitable for the display panel 110. The timing controller 130 may generate compensation image data RGB' by compensating for image data according to the sensing data SD provided from the data driver 140. The compensation image data RGB' may be output to the data driver 140 along with the data control signal DCS. The compensation image data RGB' can compensate for the characteristic change of the driving TFT DT of each pixel P of the display panel 110.

Figure 4:
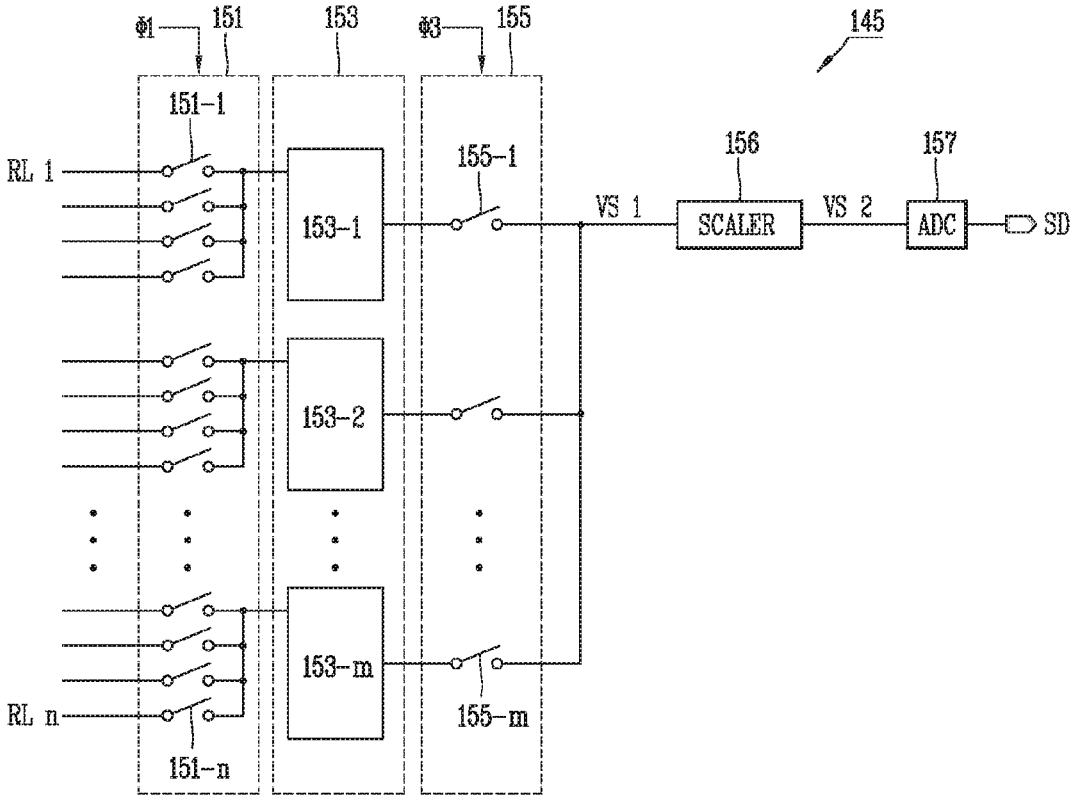
FIG. 4 is a view illustrating a detailed configuration of a sensing unit of a data driver illustrated in FIG. 3.

FIG. 4 is a view illustrating a detailed configuration of a sensing unit of a data driver illustrated in FIG. 3.

As illustrated in FIGS. 3 and 4, the sensing unit 145 according to this exemplary embodiment may generate sensing data SD from voltages applied through the plurality of reference lines RL, for example, sensing voltages obtained by sensing the threshold voltage Vth of the pixel P, and output the generated sensing data SD.

The sensing unit 145 may include a first switch module 151, a sampling and holding module 153, a second switch module 155, a scaler 156 and an analog-digital converter 157. The sensing unit 145 may be provided at each of the plurality of data drivers 140.

The first switch module 151 may be disposed between a plurality of reference lines RL1 to RLn and the sampling and holding module 153. The first switch module 151 may include a plurality of switches 151-1 to **151-*n* corresponding to the plurality of reference lines RL1** to RLn, respectively, where n may be a positive integer.

The plurality of switches 151-1 to **151-*n* of the first switch module 151 may sequentially perform a switching operation according to a switching signal, for example, a first switching signal ø1, applied from the timing controller 130. The first switch module 151 may output sensing voltages from the plurality of reference lines RL1** to RLn through the switching operation.

Meanwhile, each of the plurality of data drivers 140 may be connected to about 768 data lines and reference lines among a plurality of data lines DL1 to DLn and the plurality of reference lines RL1 to RLn of the display panel 110. Accordingly, the first switch module 151 may include the switches 151-1 to **151-*n* corresponding to the 768** reference lines, respectively.

The sampling and holding module 153 may temporarily store the sensing voltages input through the first switch module 151 and output the temporarily-stored sensing voltages. The sampling and holding module 153 may include a plurality of sampling and holding circuits 153-1 to **153-*m***.

Each of the plurality of sampling and holding circuits 153-1 to **153-*m* may be connected to the plurality of switches 151-1 to 151-*n* of the first switch module 151, respectively. In this instance, each of the plurality of sampling and holding circuits 153-1 to 153-*m* may be connected to four switches of the first switch module 151, where m may be a positive integer. Since the first switch module 151 includes the 768 switches 151-1 to 151-*n*, the sampling and holding module 153 may include 192 sampling and holding circuits 153-1 to 153-*m***.

Figure 5:
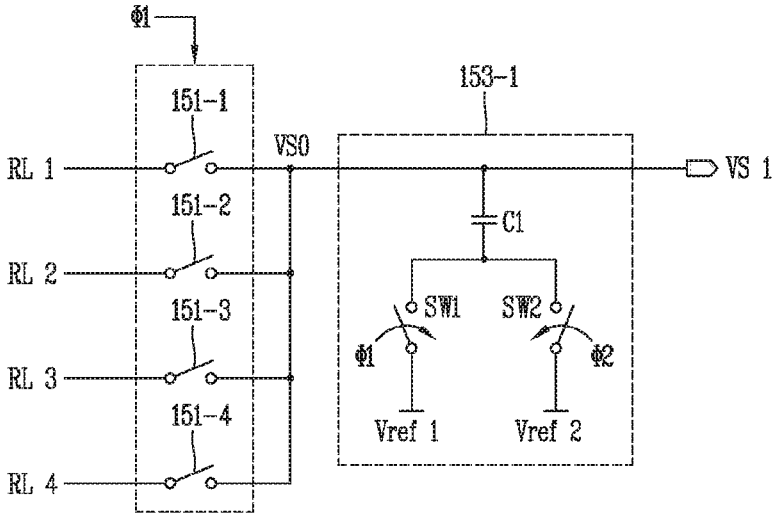
FIG. 5 is a view illustrating one sampling and holding circuit of a sampling and holding module illustrated in FIG. 4.

FIG. 5 is a view illustrating one sampling and holding circuit of a sampling and holding module illustrated in FIG. 4.

As illustrated in FIGS. 4 and 5, the sampling and holding circuit 153-1 may be connected to four switches 151-1 to 151-4 of the first switch module 151. The sampling and holding circuit 153-1 may include a first capacitor C1, a first switch SW1 and a second switch SW2.

The first switch SW1 may be connected between a first reference voltage Vref1 and the first capacitor C1, and the second switch SW2 may be connected between a second reference voltage Vref2 and the first capacitor C1. The first switch SW1 may perform a switching operation according to a first switching signal ø1 along with the switches 151-1 to 151-4 of the first switch module 151. The second switch SW2 may perform a switching operation according to a second switching signal ø2. Here, the first reference voltage Vref1 may be greater than the second reference voltage Vref2.

The sampling and holding circuit 153-1 may output a sampling voltage VS1 from the sensing voltage input through the first switch module 151. Also, the sampling voltage VS1 may be greater than the sensing voltage.

Hereinafter, the operation of the sampling and holding circuit 153-1 will be described in detail. For the sake of explanation, an operation of the sampling and holding circuit 153-1 when the first switch 151-1 of the first switch module 151 is switched on and outputs a sensing voltage VS0 will be exemplarily described.

First, in a state where the first switch 151-1 of the first switch module 151 and the first switch SW1 and the second switch SW2 of the sampling and holding circuit 153-1 are all turned off, the first switch 151-1 of the first switch module 151 may be turned on in response to a first switching signal ø1. Also, the first switch SW1 of the sampling and holding circuit 153-1 may also be turned on in response to the first switching signal ø1.

In this instance, the first capacitor C1 of the sampling and holding circuit 153-1 may be charged with a predetermined voltage. For example, the first capacitor C1 may be charged with a first voltage VS0−Vref1 having a level that is as great as a first reference voltage Vref1 being subtracted from the sensing voltage VS0.

In the charged state of the first voltage VS0−Vref1 in the first capacitor C1 of the sampling and holding circuit 153-1, the first switch 151-1 of the first switch module 151 and the first switch SW1 of the sampling and holding circuit 153-1 may be turned off. And, the second switch SW2 of the sampling and holding 153-1 may be turned on in response to a second switching signal ø2.

The first capacitor C1 of the sampling and holding circuit 153-1 may maintain the charged voltage, namely, the first voltage VS0−Vref1. A voltage of an output node of the sampling and holding circuit 153-1 may be a second voltage VS0−Vref1+Vref2 having a level that is as great as a second reference voltage Vref2 being added to the first voltage VS0−Vref1.

Afterwards, when the second switch SW2 of the sampling and holding circuit 153-1 is turned off in response to the second switching signal ø2, the output node voltage of the sampling and holding circuit 153-1, namely, the second voltage VS0−Vref1+Vref2 may be output as a sampling voltage VS1.

In this manner, the sampling and holding circuit 153-1 according to this exemplary embodiment may be charged with the sensing voltage VS0 applied from the reference lines RL through the first switch module 151, and then output the charged sensing voltage VS0 as the sampling voltage VS1. Here, the sampling voltage VS1 may be smaller than the sensing voltage VS0.

In the meantime, the sampling and holding circuit 153-1 illustrated in FIG. 5 may be connected to the four reference line RL1 to RL4 through the four switches 151-1 to 151-4 of the first switch module 151. The four switches 151-1 to 151-4 of the first switch module 151 may sequentially perform a switching operation in response to the first switching signal ø1, such that four sensing voltages can be input to the sampling and holding circuit 153-1. Accordingly, the sampling and holding circuit 153-1 may sequentially output four sampling voltages VS1 by repetitively performing the aforementioned operation. The four switches 151-1 to 151-4 of the first switch module 151 may simultaneously perform the switching operation such that four sensing voltages can be input to the sampling and holding circuit 153-1.

Referring back to FIG. 4, the second switch module 155 of the sensing unit 145 may be located between the sampling and holding module 153 and the scaler 156. The second switch module 155 may include a plurality of switches 155-1 to **155-*m* corresponding to the plurality of sampling and holding circuits 153-1 to 153-*m* of the sampling and holding module 153**, respectively.

The plurality of switches 155-1 to **155-*m* of the second switch module 155 may sequentially perform a switching operation in response to a switching signal, for example, a third switching signal ø3, input from the timing controller 130. The switching operation of the second switch module 155 may allow sampling voltages VS1, which are output from the plurality of sampling and holding circuits 153-1 to 153-*m* of the sampling and holding module 153, respectively, to be sequentially output to the scaler 156**.

Meanwhile, the foregoing description has been given of the sampling and holding module 153 with the 192 sampling and holding circuits 153-1 to **153-*m*. Therefore, the second switch module 155 may include 192 switches 155-1 to 155-*m***.

The scaler 156 may be connected commonly to the plurality of switches 155-1 to **155-*m* of the second switch module 155. The scaler 156 may output scaling voltages VS2 by scaling the sampling voltages VS1, which are sequentially input through the second switch module 155**. The scaling voltage VS2 may be smaller than the sampling voltage VS1.

Figure 6:
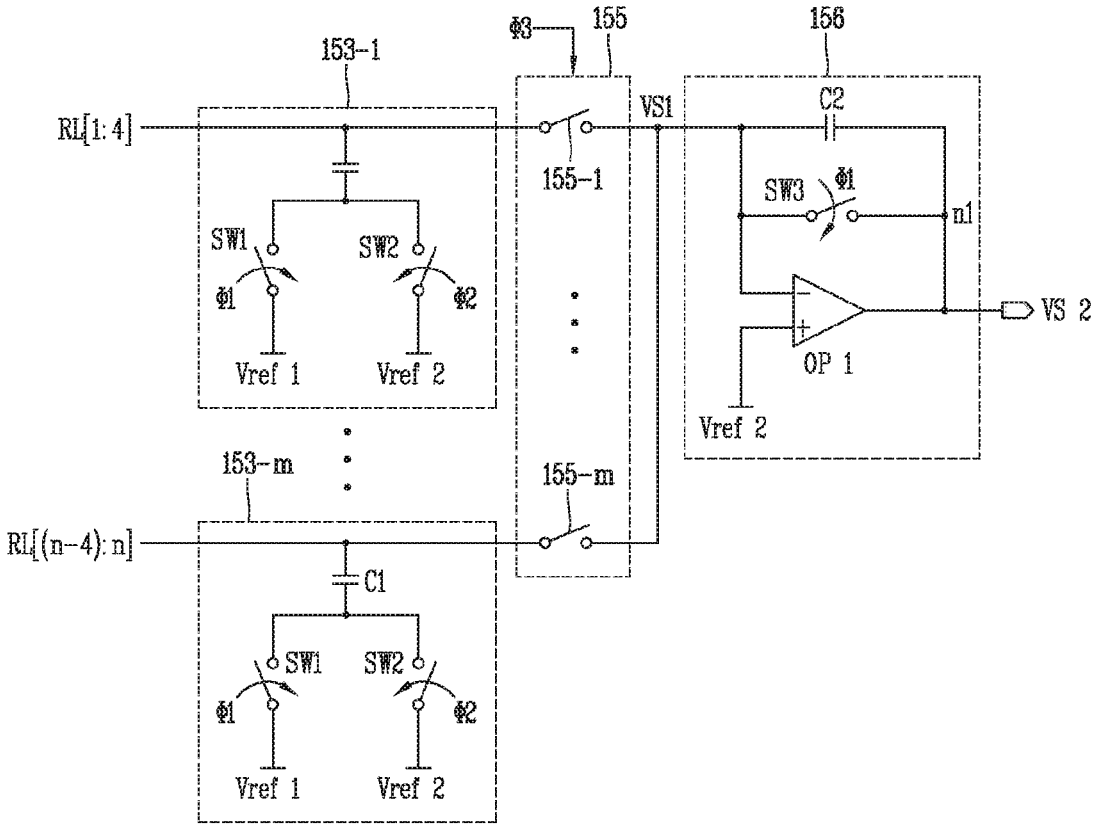
FIG. 6 is a view illustrating in detail a connection between a sampling and holding module and a scaler illustrated in FIG. 4.

FIG. 6 is a view illustrating in detail a connection between a sampling and holding module and a scaler illustrated in FIG. 4.

As illustrated in FIGS. 4 to 6, as aforementioned, the sampling and holding module 153 may include the plurality of sampling and holding circuits 153-1 to **153-*m*, and each of the sampling and holding circuits 153-1 to 153-*m*** may include the first capacitor C1, the first switch SW1 and the second switch SW2.

The plurality of switches 155-1 to **155-*m* of the second switch module 155, which correspond to the sampling and holding circuits 153-1 to 153-*m*, respectively, may be arranged between the sampling and holding module 153 and the scaler 156**.

The scaler 156 may scale and output the sampling voltages VS1, which are sequentially output from the sampling and holding module 153 through the second switch module 155. The scaler 156 may output the scaling voltages VS2 by reducing level of the sampling voltages VS1 for generating voltages belonging to a processible range of an analog-digital converter (ADC) 157, which will be explained later. The scaler 156 may include an operational amplifier (OPAMP) OP1, a second capacitor C2 and a third switch SW3.

The OPAMP OP1 may be provided with a first input port (−), a second input port (+), and an output port. The second reference voltage Vref2 may be input to the second input port (+) of the OPAMP OP1. The scaling voltage VS2 may be output through the output port of the OPAMP OP1. The second reference voltage Vref2 input to the second input port (+) of the OPAMP OP1 may be the same as or different from the second reference voltage Vref2 previously described in the sampling and holding circuits 153-1 to **153-*m***.

The second capacitor C2 and the third switch SW3 may be connected between the first input port (−) and the output port of the OPAMP OP1. The third switch SW3 may perform a switching operation in response to the first switching signal ø1. Here, the second capacitor C2 may be connected in parallel to the third switch SW3.

Hereinafter, the operation of the scaler 156 will be described in detail. For the sake of explanation, an operation of one, namely, the first sampling and holding circuit 153-1 of the plurality of sampling and holding circuits 153-1 to **153-*m*, and an operation of the scaler 156** will be described.

First, the first switch SW1 of the first sampling and holding circuit 153-1 may be turned on in response to the first switching signal ø1, such that the first voltage VS0−Vref1 can be charged in the first capacitor C1. In this instance, the third switch SW3 of the scaler 156 may also be turned on in response to the first switching signal ø1. The second capacitor C2 may be discharged by the turned-on third switch SW3 so as to be initialized. Also, parasitic capacitance within the second switch module 155 may be initialized by the turned-on third switch SW3.

Afterwards, the first switch SW1 of the first sampling and holding circuit 153-1 and the third switch SW3 of the scaler 156 may be turned off, in response to the first switching signal ø1, and the second switch SW2 of the first sampling and holding circuit 153-1 may be turned on, in response to the second switching signal ø2. In this instance, the first capacitor C1 of the sampling and holding circuit 153-1 may maintain the charged voltage, namely, the first voltage VS0−Vref1, and a voltage of an output node of the first sampling and holding circuit 153-1 may be a second voltage VS0−Vref1+Vref2 having a level that is as great as a second reference voltage Vref2 being added to the first voltage VS0−Vref1.

Continuously, the second switch SW2 of the sampling and holding circuit 153-1 may be turned off in response to the second switching signal ø2, and the first switch 155-1 of the second switch module 155 may be turned on in response to the third switching signal ø3. Accordingly, the first sampling and holding circuit 153-1 may output the voltage of the output node thereof, namely, the second voltage VS0−Vref1+Vref2 to the scaler 156 as the sampling voltage VS1.

The second capacitor C2 of the scaler 156 can be charged with a predetermined voltage by the sampling voltage VS1. For example, the second capacitor C2 of the scaler 156 may be charged with a voltage which corresponds to a capacitance ratio of the first capacitor C1 of the first sampling and holding circuit 153-1 to the second capacitor C2 of the scaler 156.

Meanwhile, the second capacitor C2 should be formed to have a greater capacity than the first capacitor C1 of the first sampling and holding circuit 153-1, in order to improve a scaling performance of the scaler 156, namely, a performance of reducing a level of the sampling voltage V1. According to the difference of the capacity, the voltage charged in the second capacitor C2 may be smaller than the sampling voltage VS1

For example, the second capacitor C2 may be charged with a voltage according to the following [Equation 1].

$$VC2=C1/C2*VC1 \quad \text{[Equation 1]}$$

where VC1 denotes a first voltage charged in the first capacitor of the sampling and holding circuit.

Then, the OPAMP OP1 of the scaler 156 may output the scaling voltage VS2 from the voltage charged in the second capacitor C2. Here, the OPAMP OP1 may operate as a current integrator. Accordingly, the scaling voltage VS2 output from the OPAMP OP1 may have a level that is as great as the voltage charged in the second capacitor C2 being subtracted from the second reference voltage Vref2.

Meanwhile, the scaler 156 illustrated in FIG. 6 may be connected to the plurality of sampling and holding circuits 153-1 to **153-*m* through the plurality of switches 155-1 to 155-*m* of the second switch module 155. Accordingly, the scaler 156 may repetitively perform the aforementioned operations as many times as the number of the sampling and holding circuits 153-1 to 153-*m*, so as to sequentially output a plurality of sampling voltages, namely, the plurality of scaling voltages VS2 as many as the number of the sampling voltages VS1 output from the plurality of sampling and holding circuits 153-1 to 153-*m***.

Referring back to FIG. 4, an ADC 157 may be connected to a rear end of the scaler 156. The ADC 157 may output sensing data SD by performing an analog-digital conversion for the scaled scaling voltage VS2 output from the scaler 156.

The sensing data SD, as illustrated in FIG. 3, may be output to the timing controller 130. The timing controller 130 may generate compensation image data RGB' by compensating for image data according to the sensing data SD.

As aforementioned, the sensing unit 145 according to this exemplary embodiment may be provided with the single scaler 156 which corresponds to each of the plurality of sampling and holding circuits 153-1 to **153-*m* of the sampling and holding module 153**, and accordingly sample/hold and scale the sensing voltages supplied through the plurality of reference lines RL to output the plurality of scaling voltages VS2.

The sensing unit 145 according to this exemplary embodiment can be provided with a remarkably reduced number of the scaler 156, as compared with the related art sensing unit, which may allow for reducing a size of the scaling unit 145 and a size of the data driver 140 including the sensing unit 145 accordingly.

Also, as the sensing unit 145 is provided with the single scaler 156, an internal capacitor of the scaler 156, namely, the capacity of the second capacitor C2 can further be increased, thereby enhancing the scaling performance of the scaler 156.

The scaler 156 can be configured as the current integrator using the OPAMP OP1, so as to minimize an affection of parasitic capacitance, which is generated due to the switching operation of the second switch module 155, by virtue of the OPAMP OP1, as compared with the related art sensing unit. Consequently, a generation of an error in the scaling voltage VS2 output from the scaler 156 due to the parasitic capacitance can be prevented, which may result in outputting more accurate sensing data SD.

Therefore, in the OLED display device according to the present invention, the size of the data driver 140 can be reduced by reducing the size of the sensing unit 145, and accuracy of the compensation image data RGB' generated in the timing controller 130 can be improved by outputting accurate sensing data SD from the sensing unit 145. Also, the compensation image data RGB' can be used for compensating for a characteristic change of each pixel P of the display panel, which may prevent display quality of the display panel 110 from being lowered.

Figure 7:
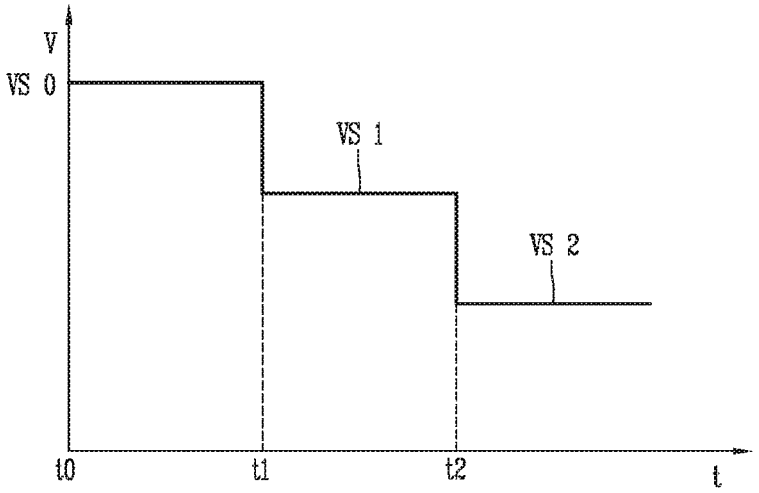
FIG. 7 is a view illustrating an output voltage according to an operation of a sensing unit in accordance with one exemplary embodiment of the present invention.

FIG. 7 is a view illustrating an output voltage according to an operation of a sensing unit in accordance with one exemplary embodiment of the present invention.

As illustrated in FIGS. 4 to 7, when the plurality of switches 151-1 to **151-*n* of the first switch module 151 are turned on at a time t0, an initial sensing voltage VS0 may be input to the sampling and holding module 153** through the plurality of reference lines RL.

Afterwards, when the first switch module 151 is turned off and the second switch SW2 provided in each of the plurality of sampling and holding circuits 153-1 to **153-*m* of the sampling and holding module 153 is turned on at a time t1, the sampling and holding module 153** may sequentially output the plurality of sampling voltages VS1. In this instance, the sampling voltage VS1 may be a voltage (i.e., VS0−Vref1+Vref2) obtained by adding the second reference voltage Vref2 to the voltage (VS0−Vref1), which is obtained by subtracting the first reference voltage Vref1 from the initial sensing voltage VS0.

Continuously, when the second switch SW2 of each of the plurality of sampling and holding circuits 153-1 to **153-*m* of the sampling and holding module 153 is turned off and the plurality of switches 155-1 to 155-*m* of the second switch module 155 are turned on at a time t2, the scaler 156** may sequentially output the plurality of scaling voltages VS2. In this instance, the scaling voltage VS2 may be a voltage obtained by subtracting the voltage charged in the second capacitor C2 from the second reference voltage Vref2.

When the plurality of switches 155-1 to **155-*m* of the second switch module 155 are turned off, the scaler 156 may output the scaling voltages VS2 to the ADC 157**.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims

What is claimed is:

1. A sensing circuit comprising:

N sampling and holding circuits to output a plurality of sampling voltages from a plurality of sensing voltages sequentially input through a plurality of reference lines, where N is a positive integer;

a single scaler commonly connected to the N sampling circuits to output a plurality of scaling voltages from the plurality of sampling voltages;

an analog-digital converter to perform an analog-digital conversion for the plurality of scaling voltages so as to output a plurality of sensing data; and a plurality of switches disposed between the N sampling and holding circuits and the single scaler and provided by the same number as the N sampling and holding circuits, wherein the plurality of switches are sequentially turned on to output the sampling voltages to the single scaler.

2. The sensing circuit of claim 1, wherein each of the N sampling and holding circuits comprises:

a first capacitor commonly connected to a predetermined number of reference lines of the plurality of reference lines;

a first switch disposed between the first capacitor and a first reference voltage; and a second switch disposed between the first capacitor and a second reference voltage, wherein the first switch and the second switch are turned on according to a first switching signal and a second switching signal in an alternating manner, such that the sampling voltage is output from the sensing voltage.

3. The sensing circuit of claim 2, further comprising a plurality of switches disposed between the plurality of reference lines and the N sampling and holding circuits.

4. The sensing circuit of claim 3, wherein the plurality of switches are provided by the same number as the plurality of reference lines, and turned on in response to the first switching signal to output the sensing voltages to the N sampling and holding circuits.

5. The sensing circuit of claim 1, wherein the single scaler comprises:

an operational amplifier (OPAMP) provided with a first input port connected commonly to the N sampling and holding circuits, a second input port connected to a second reference voltage, and an output port;

a second capacitor connected between the first input port and the output port of the operational amplifier; and a switch connected in parallel to the second capacitor between the first input port and the output port of the operational amplifier.

6. The sensing circuit of claim 5, wherein each of the N sampling and holding circuits is provided with a first capacitor, wherein the second capacitor is charged with a voltage obtained by multiplying a voltage charged in the first capacitor and a capacitance ratio of the first capacitor to the second capacitor, and wherein the scaling voltage has a level that is as great as the voltage charged in the second capacitor being subtracted from the second reference voltage.

7. The sensing circuit of claim 5, wherein the switch of the single scaler is turned on in response to a first switching signal to initialize the second capacitor.

8. The sensing circuit of claim 1, wherein the single scaler operates as a current integrator.

9. The sensing circuit of claim 1, wherein the plurality of switches are sequentially turned on in response to a third switching signal.

10. An organic light emitting diode (OLED) display device, comprising:

a display panel provided with a plurality of pixels, and a plurality of reference lines connected to the plurality of pixels, respectively, each of the pixel having an organic light emitting diode;

a plurality of data drivers each provided with a sensing circuit to output sensing data from sensing voltages applied through the plurality of reference lines; and a timing controller to generate a compensation image data from image data according to the sensing data, and output the compensation image data to the display panel through the data driver, wherein the sensing circuit comprises:

N sampling and holding circuits to output a plurality of sampling voltages from a plurality of sensing voltages sequentially input through the plurality of reference lines, where N is a positive integer;

a single scaler commonly connected to each of the N sampling circuits to output a plurality of scaling voltages from the plurality of sampling voltages;

an analog-digital converter to perform an analog-digital conversion for the plurality of scaling voltages so as to output a plurality of sensing data; and a plurality of switches disposed between the N sampling and holding circuits and the single scaler and provided by the same number as the N sampling and holding circuits, wherein the plurality of switches are sequentially turned on to output the sampling voltages to the single scale.

11. The OLED display device of claim 10, wherein each of the N sampling and holding circuits comprises:

a first capacitor commonly connected to a predetermined number of reference lines of the plurality of reference lines; and a first switch disposed between the first capacitor and a first reference voltage.

12. The OLED display device of claim 11, wherein each of the N sampling and holding circuits further comprises:

a second switch disposed between the first capacitor and a second reference voltage, wherein the first switch and the second switch are turned on according to a first switching signal and a second switching signal in an alternating manner, such that the sampling voltage is output from the sensing voltage.

13. The OLED display device of claim 10, further comprising a plurality of switches disposed between the plurality of reference lines and the N sampling and holding circuits.

14. The OLED display device of claim 10, wherein the single scaler operates as a current integrator.

15. The OLED display device of claim 10, wherein the plurality of switches are sequentially turned on in response to a third switching signal.

* * * * *